US008616875B2

(12) United States Patent
Ryu et al.

(10) Patent No.: US 8,616,875 B2
(45) Date of Patent: Dec. 31, 2013

(54) LIGHT GUIDE PLATE STAMP AND METHOD OF MANUFACTURING THE SAME

(75) Inventors: Ho-Han Ryu, Suwon-si (KR); Tae-Seok Kim, Suwon-si (KR); Seung-Pyo Hong, Hwaseong-si (KR); Seung-Yeop Lee, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 157 days.

(21) Appl. No.: 13/240,982

(22) Filed: Sep. 22, 2011

(65) Prior Publication Data

US 2012/0006090 A1 Jan. 12, 2012

(30) Foreign Application Priority Data

Apr. 11, 2011 (KR) ..... 2011-0033027

(51) Int. Cl.
*B29C 45/34* (2006.01)
*F21V 7/04* (2006.01)
*B29D 7/00* (2006.01)

(52) U.S. Cl.
USPC ..... 425/572; 425/384; 425/812; 362/607; 362/619; 362/623; 249/78; 249/114.1; 249/135

(58) Field of Classification Search
USPC ..... 362/607, 619, 621, 623; 425/384, 470, 425/572, 810, 812; 249/78, 79, 114.1, 135
See application file for complete search history.

(56) References Cited

U.S. PATENT DOCUMENTS

| | | | | |
|---|---|---|---|---|
| 6,835,440 | B1 * | 12/2004 | Konishi et al. | 362/629 |
| 6,939,123 | B2 | 9/2005 | Peterson et al. | |
| 7,377,478 | B2 * | 5/2008 | Tahara et al. | 425/470 |
| 7,588,365 | B2 * | 9/2009 | Katsumata | 362/623 |
| 8,182,257 | B2 * | 5/2012 | Chang | 425/384 |
| 8,235,694 | B2 * | 8/2012 | Nam | 425/174.4 |
| 8,419,419 | B1 * | 4/2013 | Tseng | 425/572 |
| 8,496,370 | B2 * | 7/2013 | Hsu | 362/623 |

FOREIGN PATENT DOCUMENTS

| | | | |
|---|---|---|---|
| JP | 4181017 | B2 | 9/2008 |
| KR | 0801801 | B1 | 1/2008 |
| KR | 1020080006190 | A | 1/2008 |

* cited by examiner

*Primary Examiner* — David B Jones
(74) *Attorney, Agent, or Firm* — Innovation Counsel LLP

(57) ABSTRACT

A stamp includes a metal supporting layer, a pattern forming layer and an adhesive layer. The metal supporting layer has a first thermal conductivity. The pattern forming layer is disposed on the metal supporting layer and has a surface with a molding pattern formed thereon. The adhesive layer is disposed between the metal supporting layer and the pattern forming layer to couple the pattern forming layer to the metal supporting layer, and has a second thermal conductivity lower than the first thermal conductivity. Thus, strength of the stamp may be improved, and deformation of the stamp during the process of manufacturing a light guide plate may be reduced or prevented.

11 Claims, 4 Drawing Sheets

LIGHT GUIDE PLATE STAMP AND METHOD OF MANUFACTURING THE SAME

PRIORITY STATEMENT

This application claims priority under 35 U.S.C. §119 to Korean Patent Application No. 2011-0033027, filed on Apr. 11, 2011 in the Korean Intellectual Property Office (KIPO), the contents of which are herein incorporated by reference in their entirety.

BACKGROUND OF THE INVENTION

1. Field of the Invention

Example embodiments of the present invention relate to stamps for conducting stamping operations, as well as their methods of manufacture. More particularly, example embodiments of the present invention relate to a stamp that may be used for manufacturing a light guide plate that is to be used in flat panel displays, as well as a method of manufacturing the stamp.

2. Description of the Related Art

A liquid crystal display device is often characterized by small thickness, light weight and low power consumption. Accordingly, liquid crystal display devices have found widespread acceptance as monitors, notebook computers, mobile phones, and the like. The typical liquid crystal display device includes a liquid crystal display panel and a backlight unit. The liquid crystal display panel displays an image by controlling the light transmittance of a liquid crystal layer, and the backlight unit is disposed under the liquid crystal display panel to provide light to the liquid crystal display panel.

The backlight unit typically includes a light guide plate and a light source. The light guide plate guides light generated by a light source disposed generally on a side of the light guide plate, so that the light exits from the light guide plate toward the liquid crystal display panel. The backlight unit may further include an optical sheet. The optical sheet is disposed on the light guide plate to improve the optical characteristics of the light exiting from the light guide plate.

Alternatively, a fine optical pattern can be directly formed on a surface of the light guide plate, so that the light guide plate itself may function as the optical sheet. A light guide plate having a fine optical pattern can be formed by filling a mold with the base material for the light guide plate, and curing the material. In order to form a fine optical pattern on the light guide plate, a stamp having a molding pattern is typically used.

The stamping process usually involves pressing the stamp against the base material of the light guide plate while the material is heated to a high temperature. This high heat can result in deformation or other damage to the stamp. Furthermore, damage or deformation of the stamp may also cause deformation of the fine optical pattern.

SUMMARY OF THE INVENTION

Example embodiments of the present invention provide a stamp that may reduce or prevent deformation in the process of manufacturing a light guide plate.

Example embodiments of the present invention also provide a method of manufacturing the above-mentioned stamp.

Example embodiments of the present invention also provide a display employing the above-mentioned light guide plate.

According to an example embodiment of the present invention, a stamp includes a metal supporting layer, a pattern forming layer and an adhesive layer. The metal supporting layer has a first thermal conductivity. The pattern forming layer is disposed on the metal supporting layer and has a surface with a molding pattern formed thereon. The adhesive layer is disposed between the metal supporting layer and the pattern forming layer to couple the pattern forming layer to the metal supporting layer, and has a second thermal conductivity lower than the first thermal conductivity.

In an embodiment, the adhesive layer may include a fiber reinforced plastic.

In an embodiment, the adhesive layer may include a polymer.

In an embodiment, the pattern forming layer may include nickel.

According to another example embodiment of the present invention, a method of manufacturing a stamp is provided. In the method, an adhesive layer is disposed on a metal supporting layer having a first thermal conductivity. The adhesive layer has a second thermal conductivity lower than the first thermal conductivity. A pattern forming layer is disposed on the adhesive layer. The pattern forming layer has a molding pattern on a first surface of the pattern forming layer. The metal supporting layer, the adhesive layer and the pattern forming layer are pressed together.

In an embodiment, the pattern forming layer may be formed through an electroforming process.

In an embodiment, the pattern forming layer may be formed by forming a master having a copy pattern, which corresponds to the molding pattern, on a surface of the master, forming an electroforming copy layer on the copy pattern of the master; and separating the electroforming copy layer from the master, the electroforming copy layer having a surface with the molding pattern formed thereon.

In an embodiment, a second surface of the electroforming copy layer may be polished to be substantially flat.

In an embodiment, an exposed surface of the metal supporting layer may be polished.

In an embodiment, the adhesive layer may include a fiber reinforced plastic.

In an embodiment, the adhesive layer may include a polymer.

According to the example embodiments of the present invention, a metal supporting layer having a higher strength is combined with a pattern forming layer so that the strength of a resulting stamp may be improved. Thus, deformation of the stamp in the process of manufacturing a light guide plate and deterioration of image quality may be reduced or prevented, thereby increasing productivity of the light guide plate. Furthermore, the adhesive layer has a relatively low thermal conductivity. This improves transcription of an optical pattern.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Hereinafter, the present invention will be explained in detail with reference to the accompanying drawings.

Figure 1:
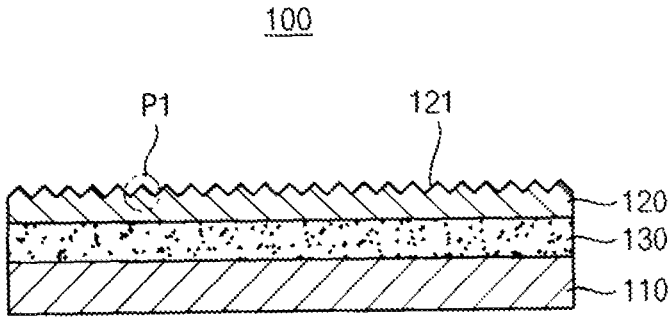
FIG. 1 is a cross-section view of a stamp according to an example embodiment of the present invention.

FIG. 1 is a cross-section view of a stamp according to an example embodiment of the present invention.

Referring to FIG. 1, stamp 100 includes a metal supporting layer 110, a pattern forming layer 120 and an adhesive layer 130.

The metal supporting layer 110 corresponds to a lowermost layer of the stamp 100, and has a first thermal conductivity. The metal supporting layer 110 is included in the stamp 100, and a higher strength than the pattern forming layer 120 so as to compensate for a low strength of the pattern forming layer 120 and to enhance mechanical strength of the stamp 100. The metal supporting layer 110 preferably has a dense structure and a high stiffness, and is easily processed to have a specular surface. Examples of a material that may be used for the metal supporting layer 110 may include a stainless steel such as SUS32.

The pattern forming layer 120 is disposed on the metal supporting layer 110, and has a molding pattern P1 formed on a first surface 121. A shape of the molding pattern P1 corresponds to a shape of an optical pattern of a light guide plate such that the molding pattern P1 is aligned with the optical pattern of the light guide plate. An example of a material that may be used for the pattern forming layer 120 may include nickel.

The adhesive layer 130 is disposed between the metal supporting layer 110 and the pattern forming layer 120 to secure the pattern forming layer 120 to the metal supporting layer 110, and has a relatively low second thermal conductivity that is lower than the first thermal conductivity. Since the adhesive layer 130 firmly secures the pattern forming layer 120 to the metal supporting layer 110, and since the adhesive layer 130 has a relatively low thermal conductivity, relatively little heat is transmitted from the pattern forming layer 120 to the metal supporting layer 110. Examples of a material that may be used for the adhesive layer 130 may include a fiber reinforced plastic (FRP), a polymer, etc. each of which yield a relatively low thermal conductivity. For example, the fiber reinforced plastic may include a glass fiber.

Since the stamp 100 according to an example embodiment of the present invention has a stacked structure including the metal supporting layer 110 having a higher strength than the pattern forming layer 120, the pattern forming layer 120 and the adhesive layer 130, a strength of the stamp 100 may be increased with compared to a stamp including only a pattern forming layer. Therefore, deformation of the stamp 100, which may be caused during the process of forming a light guide plate, may be reduced and/or prevented. Thus, the productivity for the light guide plate may be improved.

Furthermore, since the above described configuration has relatively low thermal conductivity, transcription of the optical pattern may be improved. During formation of the light guide plate, when the stamp has a high thermal conductivity, the high-temperature material of the light guide plate cools rapidly when the lower-temperature stamp is pressed thereon, so that the optical pattern is not sharply formed in the peripheral region of the light guide plate, thereby causing defects of the optical pattern. However, the stamp according to an example embodiment of the present invention includes an adhesive layer 130 having a relatively low thermal conductivity, thereby improving heat insulation between the metal supporting layer 110 and the pattern forming layer 120. Thus, defects of the optical pattern may be reduced and/or prevented.

FIGS. 2A to 2D are cross-sectional views illustrating a method of manufacturing the stamp illustrated in FIG. 1.

Figure 2A:
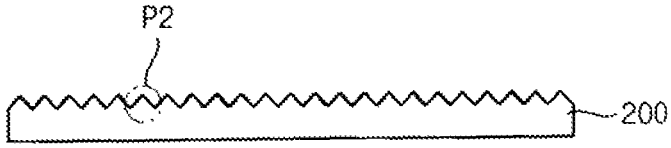
FIGS. 2A to 2D are cross-sectional views illustrating a method of manufacturing the stamp illustrated in FIG. 1.

Referring to FIG. 2A, a pattern forming layer is formed through an electroforming process. For example, a master 200 having a copy pattern P2 formed on a surface is manufactured. The copy pattern P2 corresponds to a molding pattern of the pattern forming layer. Since the molding pattern corresponds to the optical pattern of the light guide plate, the copy pattern P2 corresponds to the optical pattern of the light guide plate. For example, a metal layer may be processed to form copy pattern P2 shaped the same as the desired optical pattern. The master 200 preferably has a high electrical conductivity for the electroforming process, as well as mechanical processability.

Figure 2B:
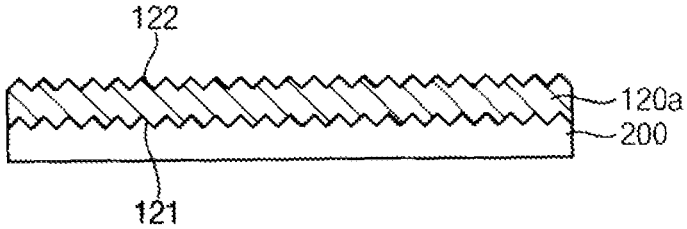

Referring to FIG. 2B, an electroforming copy layer 120*a* is formed on the copy pattern P2 of the master 200. A first surface 121 of the electroforming copy layer 120*a* has the molding pattern P1 aligned with the copy pattern P2 of the master 200. For example, the master 200 may be mounted on an electroplating apparatus for nickel electroplating. A thickness of an electroplated layer depends on time and an amount of applied current, which may be adjusted as desired. Preferably, the resulting electroplated layer, electroforming copy layer 120*a*, has a sufficient thickness to provide it with sufficient mechanical strength.

Figure 2C:
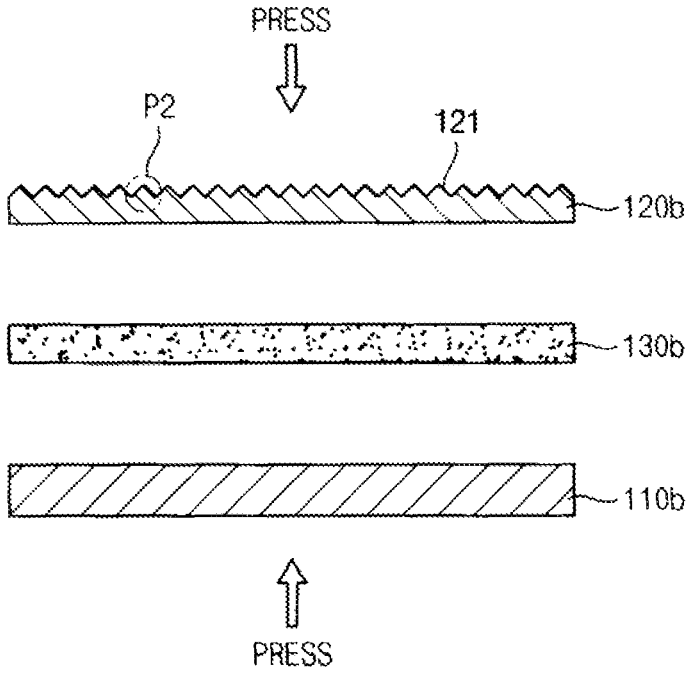

Referring to FIG. 2C, the electroforming copy layer 120*a* is separated from the master 200. Thereafter, a second surface 122 of the electroforming copy layer 120*a*, which is opposite to the first surface 121, is polished to be substantially flat, so that a pattern forming layer 120*b* is formed.

Thereafter, an adhesive layer 130*b* is disposed on a metal supporting layer 110*b*. The metal supporting layer has a first thermal conductivity, and the adhesive layer 130 has a second thermal conductivity lower than the first thermal conductivity. The pattern forming layer 120*b* is disposed on the adhesive layer. Thereafter, heat and pressure are applied to the metal supporting layer 110*b*, the adhesive layer 120*b* and the pattern forming layer 130*b* to form a preliminary stamp 100*a*.

Figure 2D:
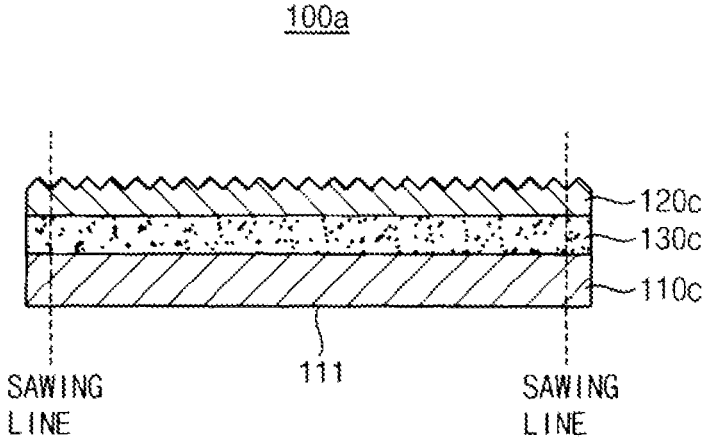

Referring to FIG. 2D, a rear surface of a metal supporting layer 110*c*, which is a lowermost layer of the preliminary stamp 100*a*, is polished to be substantially flat. Thereafter, the preliminary stamp 100*a* is cut along a predetermined sawing line to have a desired size for a mold for manufacturing the light guide plate. Accordingly, a stamp 100 is prepared.

Figure 3:
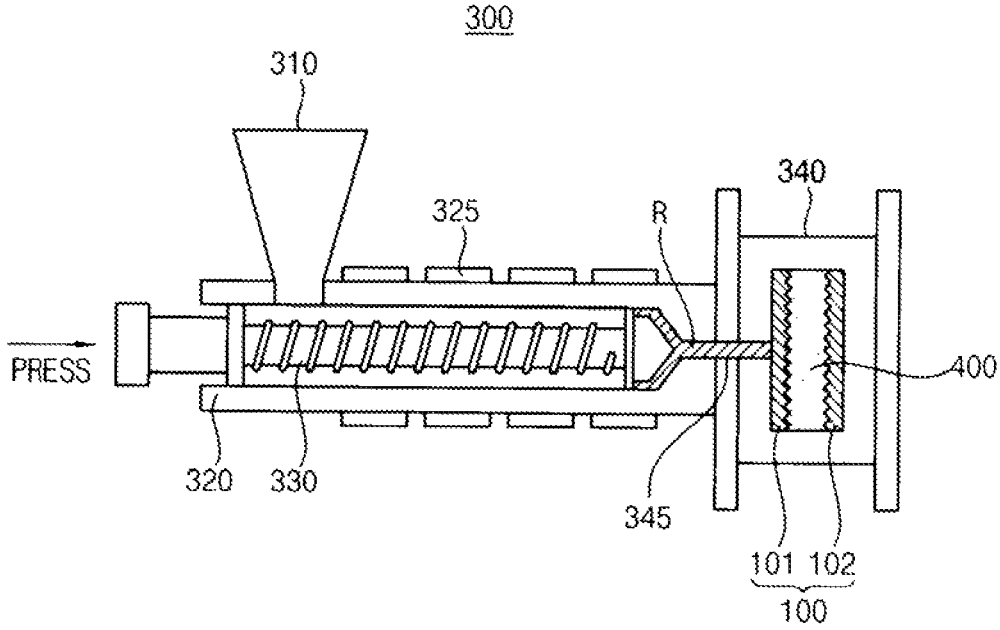
FIG. 3 is a schematic cross-sectional view illustrating an apparatus including the stamp illustrated in FIG. 1 for manufacturing a light guide plate.

FIG. 3 is a schematic cross-sectional view illustrating an apparatus for manufacturing a light guide plate using the above described stamp.

Referring to FIG. 3, an apparatus for manufacturing a light guide plate according to an example embodiment of the present invention includes a base material injecting part 310, a body 320, a cylinder 330 and a light guide plate mold 340.

The base material injecting part 310 is disposed at a side of the body 320, and a base material R for a light guide plate is injected into the body 320 through the base material injecting part 310. The base material R may include a polymer such as polymethyl methacrylate (PMMA), polycarbonate (PC), etc.

The cylinder 330 is disposed in the body 320, and is inserted through one side of the body 320. An opposite side of the body 320 is connected to the light guide plate mold 340 through a mold entrance 345. Furthermore, the body 320 may further include a heat providing part 325 for heating the base material R filled in the body 320 so as to melt the base material R.

The cylinder 330 injects the base material R, which is melted in the body 320, into the light guide plate mold 340 by applied pressure.

The light guide plate mold 340 is filled with the base material R provided through the mold entrance 345, and the base material R is cured in the light guide plate mold 340 to form a light guide plate 400.

The light guide plate mold 340 includes the stamp 100. The stamp 100 may include a first stamp 101 and a second stamp 102, which respectively correspond to an upper surface and a lower surface of the light guide plate. The first and second stamps 101 and 102 each have substantially the same structure as the stamp illustrated in FIG. 1. Thus, any repetitive explanation of the stamp is unnecessary. Those skilled in the art will understand that a shape, a thickness and a material of each of the layers of the first and second stamps 101 and 102 may be adjusted as desired.

The apparatus for manufacturing a light guide plate uses injection molding to manufacture a light guide plate, and it is to be understood that the foregoing is illustrative of the present invention and is not to be construed as limited to the specific example embodiments disclosed. Modifications to the disclosed example embodiments, as well as other example embodiments, are intended to be included within the scope of the appended claims.

Figure 4A:
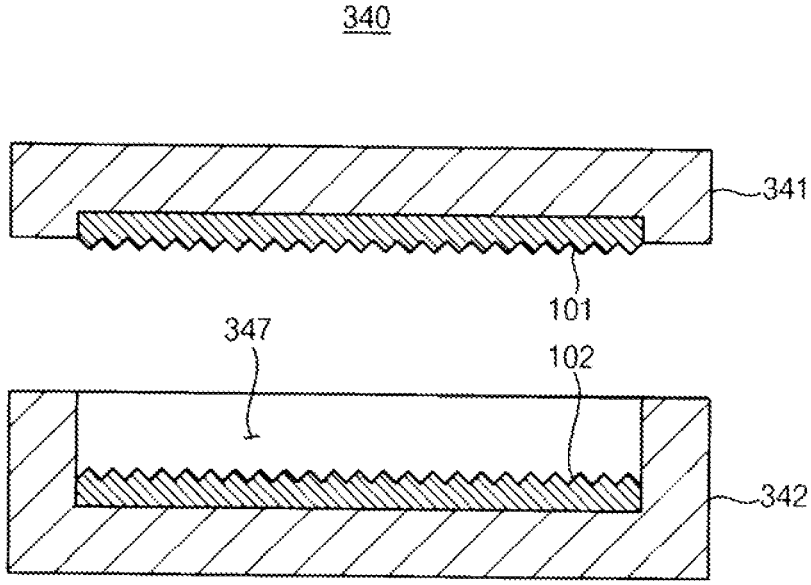
FIGS. 4A and 4B are cross-sectional views illustrating the light guide plate mold illustrated in FIG. 3.
Figure 4B:
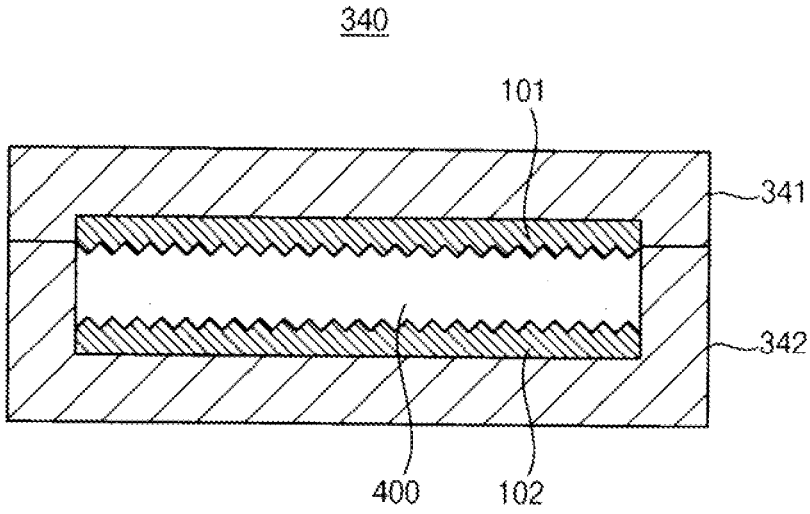
Figure 5:
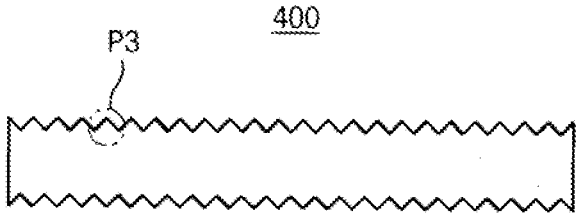
FIG. 5 is a cross-sectional view illustrating a light guide plate manufactured by the apparatus illustrated in FIG. 3.

FIGS. 4A and 4B are cross-sectional views illustrating the light guide plate mold illustrated in FIG. 3, and FIG. 5 is a cross-sectional view illustrating a light guide plate manufactured by the apparatus illustrated in FIG. 3.

Referring to FIGS. 4A, 4B and 5, the light guide plate mold 340 may include a first mold 341, a second mold 342, a first stamp 101 and a second stamp 102. The light guide plate mold 340 has a molding space 347 that may be filled with the base material R to form a light guide plate.

The molding space 347 is interposed between the first mold 341 and the second mold 342. The first stamp 101 is inserted into the first mold 341, and the second stamp is inserted into the second mold 342 to face the first stamp 101.

The first and second molds 341 and 342 are separable from, and combinable with, each other by moving the first mold 341 and/or second mold 342 away from/toward each other, respectively. When the first and second molds 341 and 342 are combined with each other, the base material R is pressed so as to impart upon it the shape of a light guide plate 400, and a molding pattern P1 of the first and second stamps 101 and 102 is transcribed to the light guide plate 400 to form an optical pattern P3. Subsequently, the first and second molds 341 and 342 may be separated from each other to separate the light guide plate 400 from the molding space 347.

The resulting light guide plate 400 has the optical pattern P3 on one surface or both surfaces, depending on whether one stamp 101/102 or two are employed. The optical pattern P3 improves optical characteristics of a light exiting from the light guide plate 400 in known fashion. For example, the optical pattern P3 may have the shape of a micro prism, and may have various shapes as desired.

According to the example embodiments of the present invention, a metal supporting layer having a higher strength is combined with a pattern forming layer and a, so that the strength of the resulting stamp may be improved. Thus, deformation of the stamp in the process of manufacturing a light guide plate, as well as resulting deterioration of image quality, may be prevented, thereby increasing the quality and effectiveness of resulting light guide plates. Furthermore, the adhesive layer has a relatively low thermal conductivity, thereby improving transcription of optical patterns.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A stamp comprising:

a metal supporting layer having a first thermal conductivity;

a pattern forming layer disposed on the metal supporting layer, the pattern forming layer having a surface with a molding pattern formed thereon; and an adhesive layer disposed between the metal supporting layer and the pattern forming layer to couple the pattern forming layer to the metal supporting layer, the adhesive layer having a second thermal conductivity lower than the first thermal conductivity.

2. The stamp of claim 1, wherein the adhesive layer includes a fiber reinforced plastic.

3. The stamp of claim 1, wherein the adhesive layer includes a polymer.

4. The stamp of claim 1, wherein the pattern forming layer includes nickel.

5. A method of manufacturing a stamp, the method comprising:

disposing an adhesive layer on a metal supporting layer having a first thermal conductivity, the adhesive layer having a second thermal conductivity lower than the first thermal conductivity;

disposing a pattern forming layer on the adhesive layer, the pattern forming layer having a molding pattern on a first surface of the pattern forming layer; and pressing the metal supporting layer, the adhesive layer and the pattern forming layer together.

6. The method of claim 5, further comprising forming the pattern forming layer through an electroforming process.

7. The method of claim 6, wherein forming the pattern forming layer further comprises:

forming a master having a copy pattern, which corresponds to the molding pattern, on a surface of the master;

forming an electroforming copy layer on the copy pattern of the master; and separating the electroforming copy layer from the master, the electroforming copy layer having a surface with the molding pattern formed thereon.

8. The method of claim 7, further comprising polishing a second surface of the electroforming copy layer to be substantially flat.

9. The method of claim 5, further comprising polishing an exposed surface of the metal supporting layer.

10. The method of claim 5, wherein the adhesive layer includes a fiber reinforced plastic.

11. The method of claim 5, wherein the adhesive layer includes a polymer.

* * * * *